US010981639B2

(12) United States Patent
Kimpara et al.

(10) Patent No.: US 10,981,639 B2
(45) Date of Patent: Apr. 20, 2021

(54) ELECTRIC OUTBOARD MOTOR

(71) Applicant: SUZUKI MOTOR CORPORATION, Hamamatsu (JP)

(72) Inventors: Masatoshi Kimpara, Hamamatsu (JP); Miku Kusunoki, Hamamatsu (JP)

(73) Assignee: Suzuki Motor Corporation

( * ) Notice: Subject to any disclaimer, the term of this patent is extended or adjusted under 35 U.S.C. 154(b) by 0 days.

(21) Appl. No.: 16/402,756

(22) Filed: May 3, 2019

(65) Prior Publication Data

US 2019/0344873 A1 Nov. 14, 2019

(30) Foreign Application Priority Data

May 8, 2018 (JP) ..... JP2018-090193

(51) Int. Cl.

| | |
|---|---|
| ***B63H 20/14*** | (2006.01) |
| ***B63H 20/28*** | (2006.01) |
| ***B63H 23/02*** | (2006.01) |
| ***B63H 20/32*** | (2006.01) |

(52) U.S. Cl.

CPC ..... *B63H 20/285* (2013.01); *B63H 20/14* (2013.01); *B63H 20/32* (2013.01); *B63H 23/02* (2013.01); *B63H 2020/323* (2013.01); *B63H 2023/0233* (2013.01)

(58) Field of Classification Search

CPC ..... B63H 20/285; B63H 20/14; B63H 23/02; B63H 20/32; B63H 2023/0233; B63H 2020/323; B63H 20/106; B63H 20/28; B63H 20/007; B63H 20/00; B63H 20/34; B63H 21/17

See application file for complete search history.

(56) References Cited

U.S. PATENT DOCUMENTS

| | | | | |
|---|---|---|---|---|
| 3,865,335 | A * | 2/1975 | Roller | B63H 20/007 248/642 |
| 3,878,809 | A * | 4/1975 | Ray | H02K 9/06 440/6 |
| 3,954,082 | A * | 5/1976 | Roller | B63H 20/007 440/6 |
| 5,967,863 | A * | 10/1999 | Marchant | B63G 13/02 181/206 |
| 2005/0020150 | A1 | 1/2005 | Bernloehr | |
| 2011/0244740 | A1* | 10/2011 | Daikoku | B63H 20/007 440/6 |
| 2014/0287283 | A1* | 9/2014 | Kimpara | H01M 2/1094 429/53 |
| 2015/0072577 | A1* | 3/2015 | Foreman | B63H 20/32 440/51 |

FOREIGN PATENT DOCUMENTS

| | | | |
|---|---|---|---|
| JP | 08002494 | A | 1/1996 |
| JP | 2003137186 | A | 5/2003 |
| JP | 2014172481 | A | 9/2014 |

* cited by examiner

*Primary Examiner* — Anthony D Wiest

(74) *Attorney, Agent, or Firm* — Barnes & Thornburg LLP

(57) ABSTRACT

In one embodiment, an electric outboard motor includes a motor casing in which an electric motor and a propeller shaft are accommodated; a shaft configured to connect the motor casing to an operation handle; a fixing member configured to fix the shaft to a hull; and a shaft adjuster provided on the shaft and configured to adjust distance between the motor casing and the fixing member.

5 Claims, 4 Drawing Sheets

ELECTRIC OUTBOARD MOTOR

CROSS-REFERENCE TO RELATED APPLICATION

This application claims the benefit of priority of Japanese Patent Application No. 2018-090193, filed on May 8, 2018, the entire contents of which are incorporated herein by reference.

BACKGROUND OF THE INVENTION

Field of the Invention

Embodiments of the present invention relate to an electric outboard motor.

Description of the Related Art

Conventionally, a propeller of an outboard motor propelling a boat has been driven by an internal combustion engine.

In recent years, from the viewpoint of environmental measures such as water pollution countermeasure and noise control, electric outboard motors that use electric motors as driving sources instead of internal combustion engines are also adopted mainly for small boats. Most of the conventional electric outboard motors have propulsion motors as driving subjects mounted on the top of the electric outboard motors.

The mounting height of the electric outboard motor with respect to the boat needs to be adjusted depending on the specification of the boat, similarly to the internal-combustion-type outboard motor (e.g., Japanese Unexamined Patent Application Publications No. 2003-137186 and No. H08-2494).

However, in the above-described conventional electric outboard motor, there is a problem that the output of the propulsion motor drops with the lapse of driving time due to heat generation.

Further, in the conventional electric outboard motor, there is also a problem that it takes time and effort to adjust the mounting height with respect to the boat, i.e., transom height adjustment.

SUMMARY OF THE INVENTION

In view of the above-described problems, an object of the present invention is to provide an environment-friendly electric outboard motor that can be easily adjusted in mounting height with respect to a hull and is excellent in cooling performance of a propulsion motor.

An electric outboard motor according to the present embodiment includes a motor casing in which an electric motor and a propeller shaft are accommodated; a shaft configured to connect the motor casing to an operation handle; a fixing member configured to fix the shaft to a hull; and a shaft adjuster provided on the shaft and configured to adjust distance between the motor casing and the fixing member.

According to the present invention, it is possible to provide an environment-friendly electric outboard motor that can be easily adjusted in mounting height with respect to a hull and is excellent in cooling performance of a propulsion motor.

DETAILED DESCRIPTION

Hereinbelow, embodiments of the present invention will be described by referring to the accompanying drawings.

In the following description, directional terms such as vertical, horizontal, upper, upward, lower, downward, above, and below are used with reference to the state in which an electric outboard motor is mounted on a hull. Additionally, "traveling direction" refers to the traveling direction of the boat. Further, the term "front" and "forward" indicate the traveling direction of the boat during normal driving and the terms "rear" and "rearward" indicate the direction opposite to the traveling direction of the boat during normal driving.

In each of FIG. 1 to FIG. 4, some components are arbitrarily omitted for simplicity.

First of all, by referring to FIG. 1, a description will be given of the electric outboard motor 10 (hereinafter, shortly referred to as "outboard motor 10") according to the present embodiment.

Figure 1:
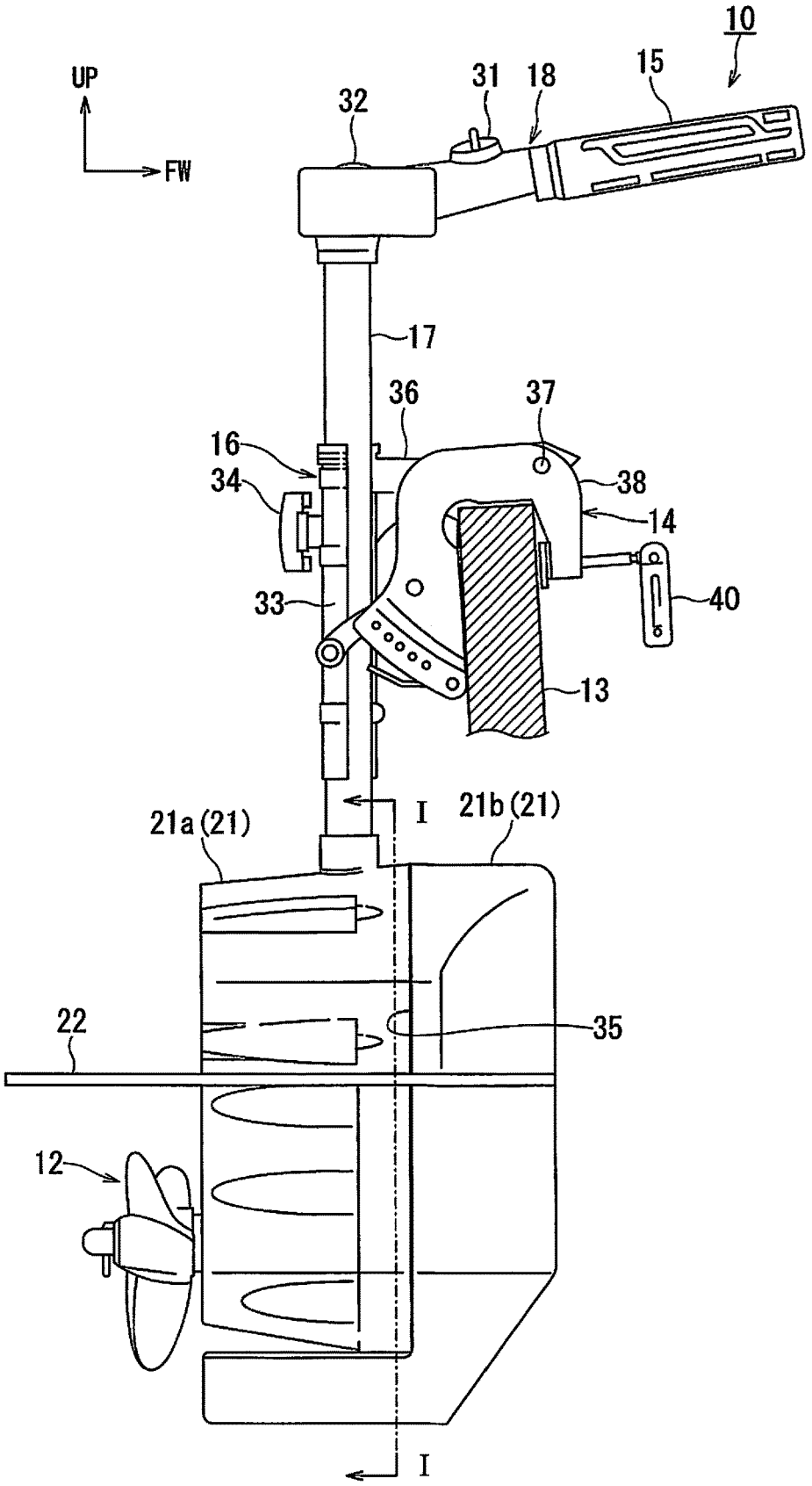
FIG. 1 is a schematic side view of an electric outboard motor according to one embodiment.

FIG. 1 is a schematic side view of the outboard motor 10 according to the embodiment.

The outboard motor 10 is generally provided at the rear end portion of the hull so as to protrude outside the boat. The outboard motor 10 includes a propeller 12 attached near its lower end portion, and propels the boat by rotating the propeller 12 underwater.

In the outboard motor 10 according to the embodiment as shown in FIG. 1, a motor casing 21 and an operation handle 18 are connected by a shaft 17 and this configuration constitute the main part of the outboard motor 10. When the operation handle 18 is swiveled in the horizontal direction, the propeller 12 provided in the motor casing 21 is swiveled in conjunction with the motor casing 21 and thereby the course, i.e., the travelling direction of the boat is changed. Further, the shaft 17 is attached to a transom 13 at the rear end of the hull via a clamp mechanism (fixing member) 14, whereby the outboard motor 10 is mounted on the hull.

Next, the configuration of the outboard motor 10 will be described in more detail by referring to FIG. 2 in addition to FIG. 1.

Figure 2:
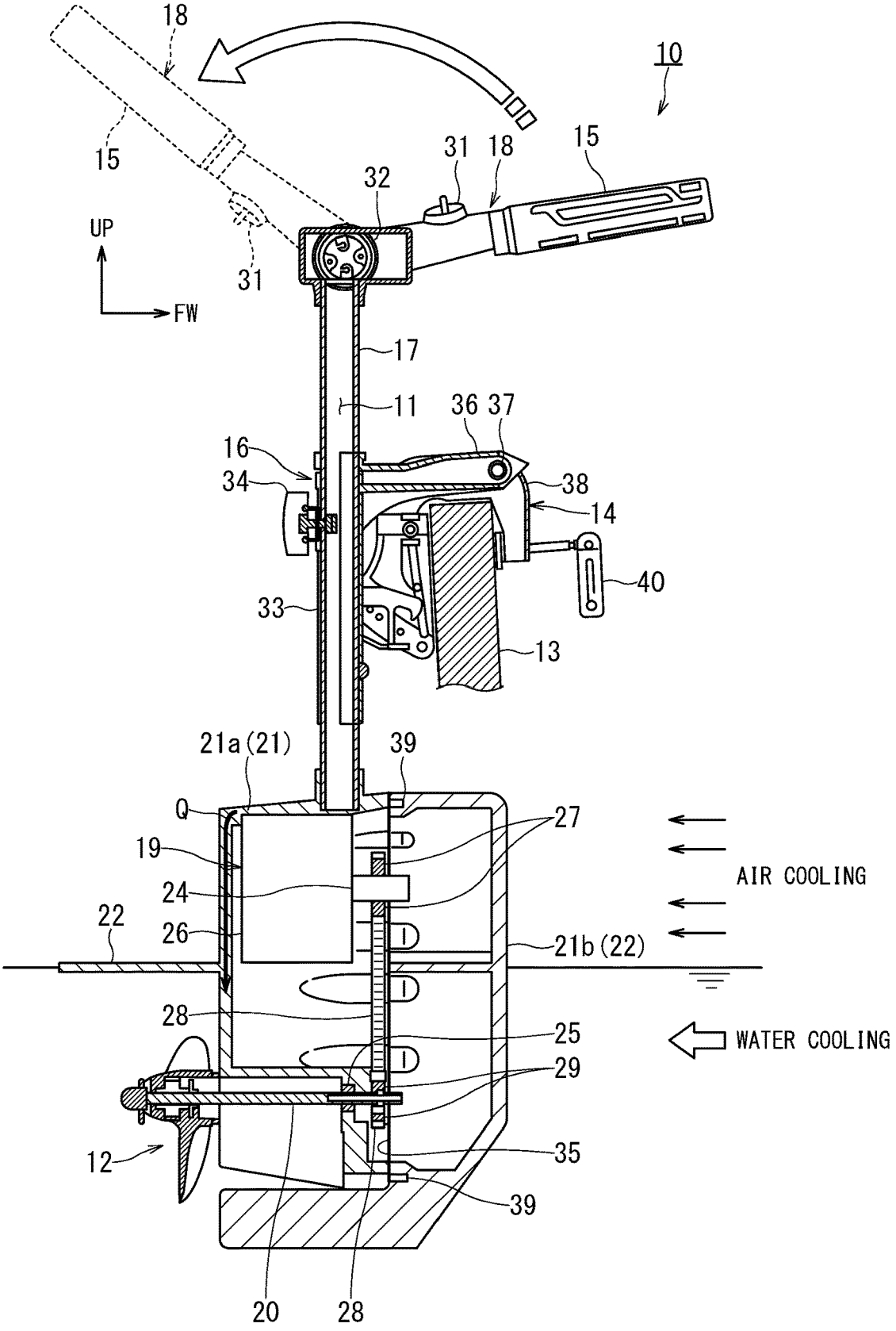
FIG. 2 is a schematic side cross-sectional view of the electric outboard motor according to the embodiment.

FIG. 2 is a schematic side cross-sectional view of the outboard motor 10 according to the embodiment.

On the outer surface on the rear side of the motor casing 21, a cavitation plate 22 is horizontally provided. Below the cavitation plate 22, a propeller 12 is disposed. The cavitation plate 22 suppresses occurrence of cavitation due to the rotation of the propeller 12 so as to convert energy to propulsive force without waste.

Normally, during planing in which the hull glides over the water surface, the position of the water surface is the position of the cavitation plate 22. In other words, during planing, the upper side of the motor casing 21 above the cavitation plate 22 is maintained on the water surface and the lower side of the motor casing 21 below the cavitation plate 22 is maintained substantially under the water surface.

The propulsion motor 19 is mounted inside the motor casing 21 in such a manner that the propulsion motor 19 makes surface contact with the motor casing 21 at the position higher than the cavitation plate 22, i.e., on the side of the operation handle 18. The heat Q generated in the propulsion motor 19 mainly conducts from the contact surface with the motor casing 21 to the metallic motor casing 21 and propagates through the wall of the motor casing 21 by thermal conduction.

The motor casing 21 is water-cooled at the portion that is immersed in water below the cavitation plate 22. The upper part of the motor casing 21 above the cavitation plate 22 is exposed to the atmosphere and is air-cooled mainly by running wind.

The motor casing 21 is composed of a rear casing member 21*a* and a front casing member 21*b* so as to be divided into two in the front-rear direction, for instance. The mating surface 35 of the rear casing member 21*a* and the front casing member 21*b* coincides with the direction perpendicular to the traveling direction. To the mating surface 35, a seal member 39 such as an O-ring or a gasket is applied, and the casing members 21*a* and 21*b* are fastened to each other by a fastener such as a bolt, so that watertightness inside the motor casing 21 is ensured.

The propulsion motor 19 is placed horizontally such that its output shaft 24 faces forward in the traveling direction. The output shaft 24 of the propulsion motor 19 may be on the front side or the rear side of a winding portion 26 of the motor main-body. In other words, the outboard motor 10 may be configured in a manner different from FIG. 2 such that the propulsion motor 19 is accommodated in the front casing member 21*b* on the hull side and the winding portion 26 is disposed so as to be closer to the hull side than its output shaft 24.

In the lower space of the propulsion motor 19, a propeller shaft 20 is arranged parallel to the output shaft 24 of the propulsion motor 19. The propeller shaft 20 is rotatably supported with rotation by the motor casing 21 via a bearing 25, and protrudes rearward of the motor casing 21 while its watertightness is being maintained by, e.g., a bush. At the rear end portion of the propeller shaft 20, a propeller 12 is pivotally supported.

The output shaft 24 of the propulsion motor 19 is provided with a drive pulley 27, and the propeller shaft 20 is provided with a driven pulley 29. Between the drive pulley 27 and the driven pulley 29, a toothed belt 28 is wound. The motor output of the propulsion motor 19 is transmitted from the output shaft 24 to the drive pulley 27, the toothed belt 28, the driven pulley 29, and the propeller shaft 20, and thereby the propeller 12 is rotated.

Instead of the toothed belt 28, a sprocket may be applied for chain drive between the propulsion motor 19 and the drive shaft 20.

Figure 3:
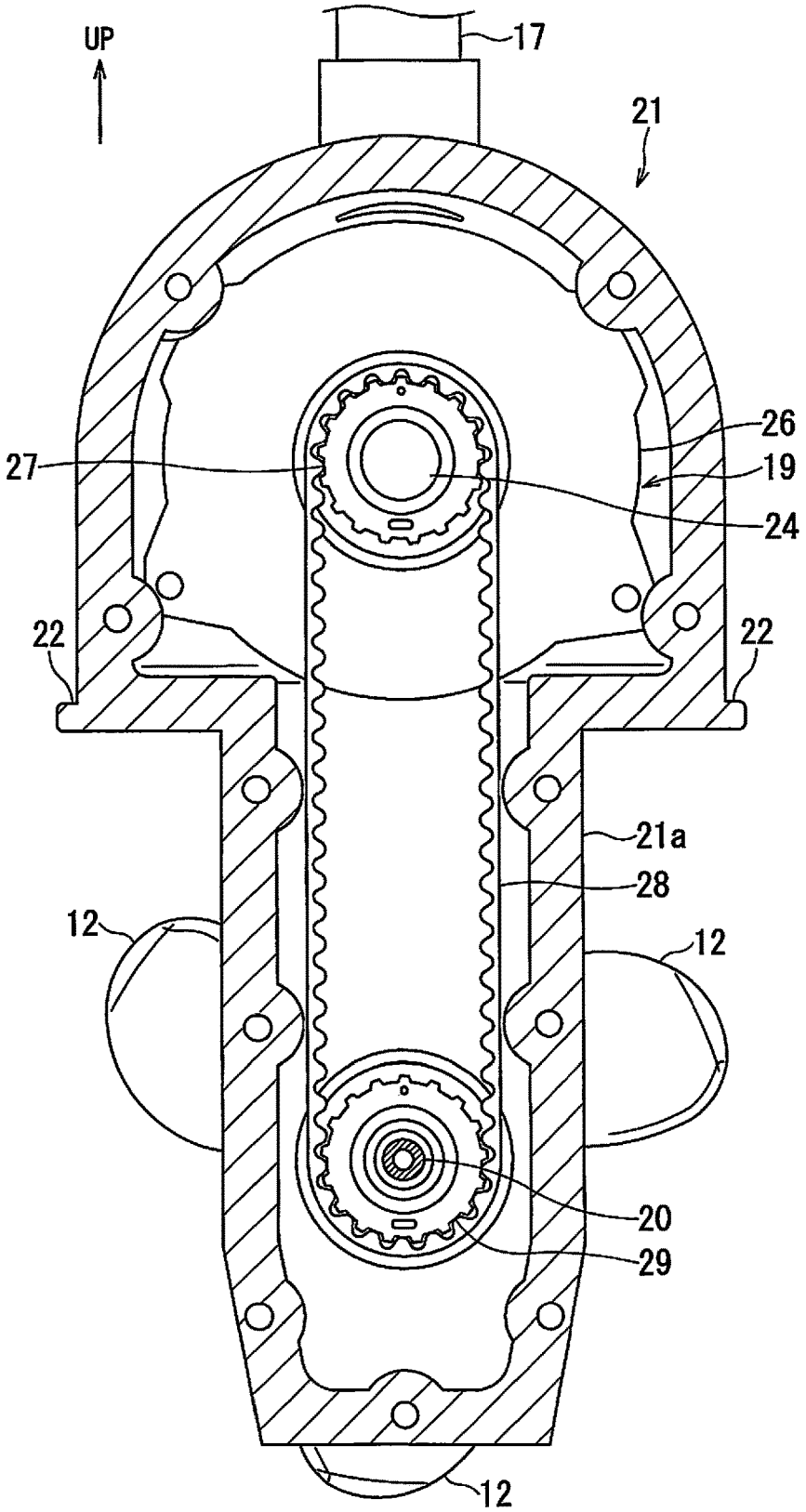
FIG. 3 is a longitudinal cross-sectional view of the motor casing taken along the line I-I of FIG. 1.

FIG. 3 is a longitudinal cross-sectional view of the motor casing 21 taken along the line I-I of FIG. 1.

As shown in FIG. 3, the propulsion motor 19 and the propeller shaft 20 are juxtaposed along the vertical direction inside the motor casing 21.

The propulsion motor 19 is larger in diameter than any of the drive pulley 27 and the driven pulley 29. Thus, viewing from the hull side, the cross-sectional shape of the motor casing 21 is substantially T-shaped in with the cavitation plate 22 as the horizontal boundary between the upper portion and the lower portion. That is, as to the respective portions of the motor casing 21, the accommodating portion for accommodating the propulsion motor 19 positioned above the water is configured to have a wider shape than the submerged portion below the accommodating portion.

Returning to FIG. 1 and FIG. 2, the description of the configuration of the outboard motor 10 will be continued.

The shaft 17 is fixed to the head top portion of the motor casing 21.

The shaft 17 is, e.g., a pipe that has a hollow space 11 in its inside and maintains the same diameter over its entire length. Through, for instance, the hollow space 11, a non-illustrated power supply cable for connecting a power switch 31 provided on the operation handle 18 to the propulsion motor 19 is passed. The shaft 17 is mounted to the clamp mechanism 14 via a shaft adjuster 16.

The shaft adjuster 16 is configured of, e.g., a cylindrical holder 33 and a locking mechanism 34. The cylindrical holder 33 is constituted by a part of a cylinder that has an inner diameter substantially equal to the outer diameter of the shaft 17. The shaft 17 is slidably held by the cylindrical holder 33.

The shaft 17 is fixed by a locking mechanism 34 provided in the cylindrical holder 33. The locking mechanism 34 includes, e.g., a locking pin that can be fitted into any one of plural holes provided in the shaft 17. This locking pin is fitted into one of the holes, and thereby the relative position of the shaft 17 with respect to the cylindrical holder 33 is fixed.

Further, the cylindrical holder 33 is supported by a swivel bracket 36 of the clamp mechanism 14 so as to be rotatable in the horizontal direction. The swivel bracket 36 is rotatably supported by right and left clamp brackets 38 via the swivel shaft 37. The clamp brackets 38 holds (i.e., grips) the transom 13.

Such a connection structure with the clamp mechanism 14 enables the shaft 17 to rotate. Additionally, the outboard motor 10 can trim and tilt with respect to the transom 13 of the boat.

The operation handle 18 for steering the boat by horizontally rotating the shaft 17 within a specific angle is connected to the top of the shaft 17. At the connected portion between the operation handle 18 and the shaft 17, a link mechanism 32 for changing the connection angle of the operation handle 18 with respect to the shaft 17 is provided.

Figure 4:
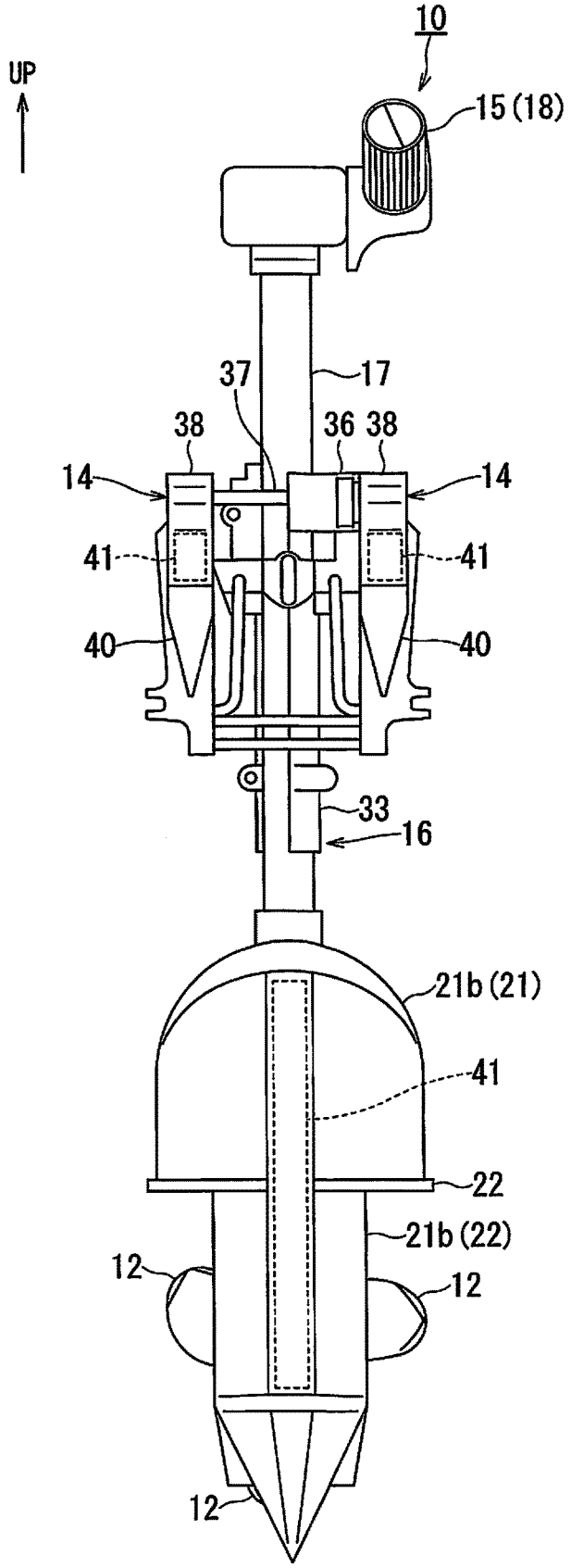
FIG. 4 is a schematic front view of the electric outboard motor according to the embodiment.

Next, a description will be given of the attitude of the outboard motor 10 at the time of being detached from the hull and stored in, e.g., a warehouse by referring to FIG. 2 and FIG. 4. FIG. 4 is a schematic front view of the outboard motor 10 according to the embodiment.

In the case of storing the outboard motor 10, the respective fixing levers 40 provided on the right and left clamp brackets 38 are detached and the outboard motor 10 is horizontally (i.e., laterally) placed such that its surface on the side opposite to the propeller 12 is grounded.

At this time, the operation handle 18 is bent in the direction away from the ground around the link mechanism 32 as shown in FIG. 2. Consequently, at the time of storage as shown in FIG. 4, the right and left clamp brackets 38 and the motor casing 21 support the outboard motor 10 by bringing the support surface 41 into contact with the grounds at three points.

Since the outboard motor 10 of the present embodiment has the above-described configuration, the following effects (1) to (9) are obtained.

(1) The propulsion motor 19 is disposed near the propeller shaft 20 and accommodated in the motor casing 21 that is partly immersed in water.

This configuration allows the propulsion motor 19, which rises in temperature due to its own heat, to be efficiently water-cooled via the motor casing 21.

In addition, when the winding portion 26 of the propulsion motor 19 is accommodated on the side of the front casing member 21*b* on the hull side, the propulsion motor 19 is further cooled by running wind, wind or splashing and the cooling efficiency of the propulsion motor 19 can be further improved.

Moreover, since the cavitation plate 22 also functions as a cooling fin, the heat dissipation efficiency of the motor casing 21 is improved and thus the cooling efficiency of the motor casing 21 is enhanced.

(2) Inside the motor casing 21, more than half of the entire length of the toothed belt 28 or the chain for transmitting the power from the propulsion motor 19 to the propeller shaft 20 is disposed in the portion below the water surface. Thus, the atmosphere inside the motor casing 21 is also easily water-cooled, so that a decrease in the service life due to thermal degradation is prevented.

(3) The propulsion motor 19 and the propeller shaft 20 are disposed on the same side with respect to the shaft adjuster 16. Accordingly, the shaft 17 supports the respective weights of the propulsion motor 19 and the propeller shaft 20 substantially at the upper side, and thus the outboard motor 10 is configured such that the bending moment with respect to the shaft 17 is less likely to occur. Hence, the connection structure between the operation handle 18 and the motor casing 21 can be constituted by the shaft 17 to be simplified. Consequently, it is possible to adjust the distance between the motor casing 21 and the clamping mechanism 14 by a simple method in which the cylindrical holder 33 slides on the shaft 17. That is, the transom height can be easily adjusted.

(4) The mating surface 35 between the rear and front casing members 21*a* and 21*b* is made perpendicular to the traveling direction. Thus, the heat Q generated in the propulsion motor 19 can be transferred to the lower portion of the motor casing 21 without being blocked by the highly heat-insulating seal member 39.

For instance, when the mating surface is provided along the horizontal direction contrastively, the heat is shut off by heat insulation at the mating surface so that the heat Q is prevented from reaching the lower portion of the motor casing 21.

(5) The position of the cavitation plate 22 is lower than the position of the propulsion motor 19. Thus, during planing in which the hull glides over the water surface, the accommodating portion of the motor casing 21 for accommodating the propulsion motor 19 is maintained above the water surface and receives air resistance instead of water resistance. Since the accommodating portion for the propulsion motor 19 has a large surface area in the direction perpendicular to the traveling direction, the overall running resistance can be reduced by causing this accommodating portion to receive air resistance that is much smaller than water resistance. That is, the outboard motor 10 is configured such that the accommodating portion for the propulsion motor 19 is made to be above the water surface, and this configuration enables travelling with less energy.

Additionally, the accommodating portion for the propulsion motor 19 receives only the air resistance that is much smaller than the water resistance. Thus, even when the motor diameter increases along with increase in the output of the propulsion motor 19, the influence on the overall running resistance due to this increase in size is reduced.

(6) Since the outboard motor 10 uses the electric motor as its driving source instead of the internal combustion engine, the outboard motor 10 generates no exhaust gas and has little influence on the environment.

(7) The propulsion motor 19 and the propeller shaft 20 are accommodated in the same motor casing 21 and are juxtaposed with their axes paralleled to each other. Thus, the toothed belt 28 or chain can be used for the power transmission means from the propulsion motor 19 to the propeller shaft 20. Hence, the toothed belt 28 or chain can efficiently transmit the power in addition to that the noise generated by the toothed belt 28 or chain is smaller as compared with the conventional bevel gear or planetary gear.

Further, the noise experienced by the operator can be reduced by placing the drive mechanism such as the propulsion motor 19 or the toothed belt 28 away from the operator.

(8) As to the attitude of the outboard motor 10 at the time of storage, the right and left clamp mechanisms 14 and the motor casing 21 are in contact with the ground at three points. Accordingly, the distance between the clamp mechanisms 14 and the motor casing 21 can be adjusted and there is a degree of freedom in the attitude at the time of storage, and consequently, the attitudes can be selected in which stability can be easily secured.

(9) The propulsion motor 19 is placed within the range connecting the three points that contact the ground at the time of storage. Thus, even when the weight of the propulsion motor 19 is increased due to increase in output, it is possible to prevent the center of gravity from becoming higher like the case where the propulsion motor 19 is disposed outside this range. In other words, even when the propulsion motor 19 increases in weight, it is possible to ensure the stability of the attitude of the outboard motor 10 at the time of storage.

The motor casing 21, which is the concentrated portion of the weight, is brought into contact with the ground at the time of storage, and the attitude at the time of storage is stabilized.

According to the above-described embodiment, it is possible to provide the environment-friendly electric outboard motor 10 that can be easily adjusted in mounting height with respect to the hull and is excellent in cooling performance of the propulsion motor 19.

While certain embodiments have been described, these embodiments have been presented by way of example only, and are not intended to limit the scope of the inventions.

The above-described embodiments may be embodied in various forms; furthermore, various omissions, substitutions, changes, and combinations of the above-described embodiments may be made without departing from the spirit of the inventions. The accompanying claims and their equivalents are intended to cover such forms or modifications as would fall within the scope and spirit of the inventions.

For instance, the number of divisions of the motor casing may be three or more.

Additionally, even when power is transmitted from the propulsion motor to the propeller shaft by a general gear train (i.e., a gear train) instead of using the belt or chain, there is no problem as a power transmission method.

Further, an ECU (Electronic Control Unit) for controlling the propulsion motor may be provided in the motor casing.

What is claimed is:

1. An electric outboard motor comprising:

a motor casing in which an electric motor and a propeller shaft are accommodated such way that the electric motor is positioned above the propeller;

a shaft extending from a top of the motor casing, the shaft configured to connect the motor casing to an operation handle;

a clamp mechanism configured to fix the shaft to a hull;

a shaft adjuster attached to the clamp mechanism and slidable on the shaft to adjust distance between the motor casing and the clamp mechanism; and a cavitation plate provided on an outer surface of the motor casing, wherein the electric motor is disposed at a higher position than the cavitation plate, and wherein the propeller is disposed at a lower position than the cavitation plate.

2. The electric outboard motor according to claim 1, wherein the motor casing is configured in a T-shape when viewed from a side of the hull.

3. The electric outboard motor according to claim 1, wherein the fixing member and the motor casing are configured to contact a ground at a time of storage; and the electric outboard motor is configured to take an attitude, in which the operating handle is moved to a position not touching the ground, at a time of storage.

4. The electric outboard motor according to claim 1, wherein the motor casing is composed of at least two members having a mating surface that is perpendicular to a traveling direction of the hull in a mounted state.

5. The electric outboard motor according to claim 4, wherein the electric motor is disposed inside one of the at least two members, and wherein the one of the at least two members being positioned opposite to a propeller connected to the propeller shaft.

* * * * *